US010170087B2

(12) United States Patent
Demin

(10) Patent No.: US 10,170,087 B2
(45) Date of Patent: Jan. 1, 2019

(54) APPARATUS FOR SOUNDING A STRING OF STRINGED INSTRUMENT

(71) Applicant: Vladimir A. Demin, Moscow (RU)

(72) Inventor: Vladimir A. Demin, Moscow (RU)

( * ) Notice: Subject to any disclaimer, the term of this patent is extended or adjusted under 35 U.S.C. 154(b) by 0 days.

(21) Appl. No.: 15/686,600

(22) Filed: Aug. 25, 2017

(65) Prior Publication Data

US 2017/0352339 A1 Dec. 7, 2017

Related U.S. Application Data

(63) Continuation of application No. PCT/RU2015/000678, filed on Oct. 15, 2015.

(30) Foreign Application Priority Data

Mar. 2, 2015 (RU) ..... 2015107031

(51) Int. Cl.
*G10H 3/00* (2006.01)
*G10F 1/16* (2006.01)
(Continued)

(52) U.S. Cl.
CPC ..... *G10F 1/16* (2013.01); *G10D 3/00* (2013.01); *G10F 1/20* (2013.01)

(58) Field of Classification Search
CPC .. G10G 7/02; G10G 3/04; G10G 7/00; G10D 3/14; G10D 3/143; G10D 3/006;
(Continued)

(56) References Cited

U.S. PATENT DOCUMENTS 4,426,907 A * 1/1984 Scholz ..... G10G 7/02 318/6
5,886,270 A * 3/1999 Wynn ..... G10D 3/14 84/313

(Continued)

FOREIGN PATENT DOCUMENTS

GB 1426203 2/1976
RU 2109351 C1 4/1998

OTHER PUBLICATIONS

International Search Report from International Application No. PCT/RU2015/000678, filed Oct. 15, 2015, dated Mar. 24, 2016.

*Primary Examiner* — Marlon Fletcher
(74) *Attorney, Agent, or Firm* — Patentbar International, P.C.

(57) ABSTRACT

The inventive device relates to musical instruments. Use of this invention in a stringed instrument ensures a simpler apparatus allowing for sounding a string of the stringed instrument in the same way as a musician does. The apparatus for sounding a string of stringed instrument comprises: a first servo motor designed for securing a mediator to an output shaft thereof and for rotating the mediator in opposing directions for ensuring an interaction of the mediator with the string; a guide disposed substantially orthogonally to the string plane of the stringed instrument and designed for moving, along one side thereof, the first servo motor from or to the string; a second servo motor mounted at the reverse side of the guide; a transmission mechanism which first end being coupled with an output shaft of the second servo motor and which second end being connected to the first servo motor.

6 Claims, 3 Drawing Sheets

(51) Int. Cl.
*G10D 3/00* (2006.01)
*G10F 1/20* (2006.01)

(58) Field of Classification Search
CPC .. G10D 3/00; G10D 3/06; G10D 1/00; G10D 3/163; G10D 3/10; G10F 1/06; G10F 1/20; G10F 1/00; G10F 5/02; G10K 15/04; F16C 3/02; H02P 9/02
See application file for complete search history.

(56) References Cited

U.S. PATENT DOCUMENTS

| | | | | |
|---|---|---|---|---|
| 6,723,904 | B1 * | 4/2004 | Dolan | G10D 3/00 84/267 |
| 7,227,068 | B1 * | 6/2007 | Van Doren | G10D 1/005 84/297 R |
| 7,968,779 | B2 | 6/2011 | Courtright et al. | |
| 9,502,010 | B1 * | 11/2016 | Cardozo | G10D 3/146 |
| 2005/0172779 | A1 * | 8/2005 | Gilmore | G10F 1/20 84/8 |
| 2009/0229445 | A1 | 9/2009 | Courtright et al. | |
| 2015/0047493 | A1 * | 2/2015 | Leadbetter | G10H 1/44 84/454 |
| 2016/0314767 | A1 * | 10/2016 | Lee | G10D 3/02 |
| 2017/0323623 | A1 * | 11/2017 | Kipness | G10D 3/16 |
| 2017/0352339 | A1 * | 12/2017 | Demin | G10D 3/00 |

* cited by examiner

APPARATUS FOR SOUNDING A STRING OF STRINGED INSTRUMENT

RELATED APPLICATIONS

This application is a Continuation application of International Application PCT/RU2015/000678, filed on Oct. 15, 2015, which in turn claims priority to Russian Patent Applications No. RU2015107031, filed Mar. 2, 2015, both of which are incorporated herein by reference in their entirety.

FIELD OF THE INVENTION

The present invention relates to musical instruments, and particularly to an apparatus for sounding a string of stringed instrument.

BACKGROUND OF THE INVENTION

Various technical solutions are used for sounding a string of stringed instrument in apparatuses for playing musical pieces automatically.

Thus, the Great Britain Patent 1426203 (publ. on Feb. 25, 1976) describes an apparatus where each string is engaged for sounding with its own gear wheel having teeth at a side surface, which gear wheel being driven and, correspondingly, engaged with the string when pressing the string due to bearing against a spring-loaded lever arm supporting this wheel near the string. This solution, besides its complexity, cannot ensure qualitative string sounding because of fact that the string, after being engaged with one tooth, can contact with the next tooth, wherefore the sound could be rattling or muffled.

The U.S. Pat. No. 6,723,904 (publ. on Apr. 20, 2004) describes an apparatus for sounding a string of stringed instrument which uses also a rotating wheel having four teeth and an axle parallel to the string. On actuating a solenoid drawing that axle, the wheel rotates following the foreseen guides and engaging the string. A disadvantage of such solution consists in its complexity.

SUMMARY OF THE INVENTION

Thus, the purpose of the present invention consists in developing a simpler apparatus allowing for sounding a string in the same way as a musician does.

In order for solving that problem and achieving the indicated common result, the present invention provides an apparatus for sounding a string of stringed instrument comprising: a first servo motor designed for securing a mediator to an output shaft thereof and for rotating the mediator in opposing directions for ensuring an interaction of the mediator with the string; a guide disposed substantially orthogonally to the string plane of the stringed instrument and designed for moving, along one side thereof, the first servo motor from or to the string; a second servo motor mounted at the reverse side of the guide; a transmission mechanism which first end being coupled with an output shaft of the second servo motor and which second end being connected to the first servo motor.

One peculiarity of the apparatus in accordance with the present invention consists in that an elastic loop can be secured at the first servo motor, which elastic loop being passed under the string and designed for damping the string oscillations when moving the first servo motor upward the guide, or being disposed above the string and designed for damping the string oscillations when moving the first servo motor downward the guide.

Another peculiarity of the apparatus in accordance with the present invention consists in that the first servo motor can be secured on a plate, at which reverse side a carriage can be made capable for moving along the guide, the second end of the transmission mechanism being connected to the first servo motor via the plate or carriage.

One more peculiarity of the apparatus in accordance with the present invention consists in that the transmission mechanism can comprise a drive arm secured to the output shaft of second servo motor, an end of which drive arm is connected pivotally to the plate or carriage.

Yet one more peculiarity of the apparatus in accordance with the present invention consists in that the transmission mechanism can comprise a worm gear wheel secured to the output shaft of second servo motor, and a mating gear rack can be made at the plate or carriage.

At last, one more peculiarity of the apparatus in accordance with the present invention consists in that the transmission mechanism can comprise one element of screw-gear secured to the output shaft of second servo motor, and the second element of the screw-gear can be connected to the plate or carriage.

BRIEF DESCRIPTION OF THE DRAWINGS

The present invention is explained using accompanying drawings, where the same numbers are assigned to the same elements.

DETAILED DESCRIPTION OF THE PREFERRED EMBODIMENTS

Figure 1:
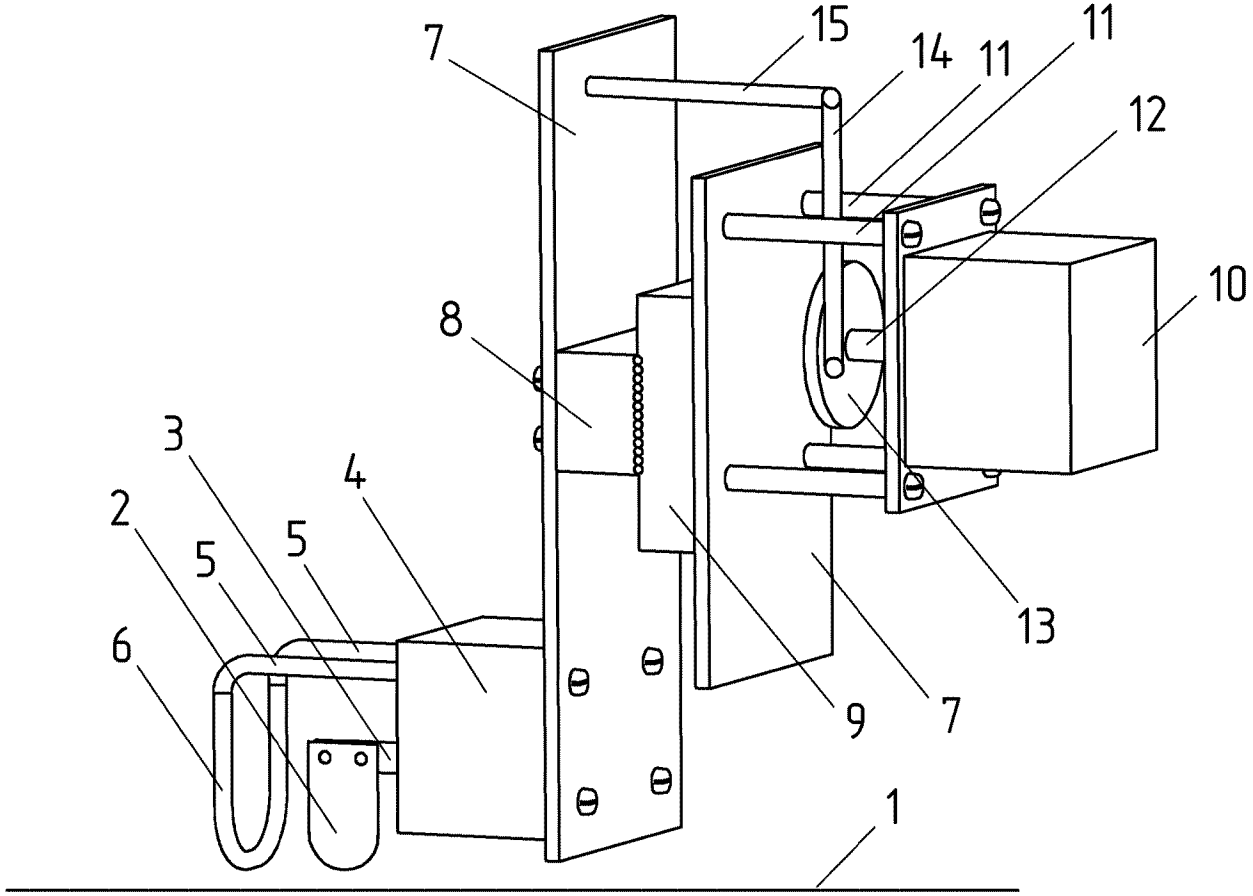
FIG. 1 shows a perspective view of the apparatus in accordance with the present invention.

FIG. 1 shows a perspective view of a part of the apparatus for sounding a string of stringed instrument in accordance with the present invention. It is possible to use a guitar as the stringed instrument, however this is only an illustration of possible embodiment rather than limitation the scope thereof.

An apparatus in accordance with the present invention comprises a mediator 2 designed for interacting with a respective string 1 of a stringed instrument. The mediator 2 is a usual guitar mediator secured at an output shaft 3 of a first servo motor 4. Two rods 5 parallel to the string 1 can be secured at a housing of the first servo motor 4, and an elastic loop 6 is joined to the end of those rods 5, the loop 6 being made, e.g., from rubber or other elastic material. The purpose of that loop 6 is explained further.

FIG. 1 shows the first servo motor 4 as mounted at one side of plate 7, and a carriage 8 capable for moving along a guide 9 is made at the reverse side of the plate 7. Those skilled in the art understand that the plate 7 and carriage 8 are shown as an example, since a part of the housing of the first servo motor 4 can move along the guide 9. Note that the guide 9 is disposed substantially perpendicularly to the string plane in the stringed instrument.

Those skilled in the art understand that the plate 7 can be made from any material possessing a suitable durability, e.g., from aluminum or synthetic-resin bonded paper laminate. The guide 9 and the carriage 8 can be made from any suitable material ensuring a sufficient sliding. Preferably, this could be aluminum, although such materials as lattin, Teflon, steel etc. are not excluded, the materials of all indicated elements could be both the same and different in any combination.

Fixation of the guide 9 to the finger-board of the stringed instrument could be performed by any means known to those skilled in the art, e.g., by braces, collars, brackets etc.

The second servo motor 10 is mounted at the reverse side of the guide 9. FIG. 1 shows the second servo motor 10 secured using posts 11 at some distance from the reverse side of the guide 9. Herewith, a drive arm 13 is fixed at the output shaft 12, to the end of which is secured a linkage 14 connected pivotally by another end to a post 15 rigidly attached to the plate 7. Those skilled in the art understand that the stop 15 could be alternatively attached to the carriage 8, or to the housing of the first servo motor 4 in the case when the housing of the first servo motor 4 directly is moved along the guide 9. Note that the drive arm 13, linkage 14 and post 15 together form a transmission mechanism.

Figure 2:
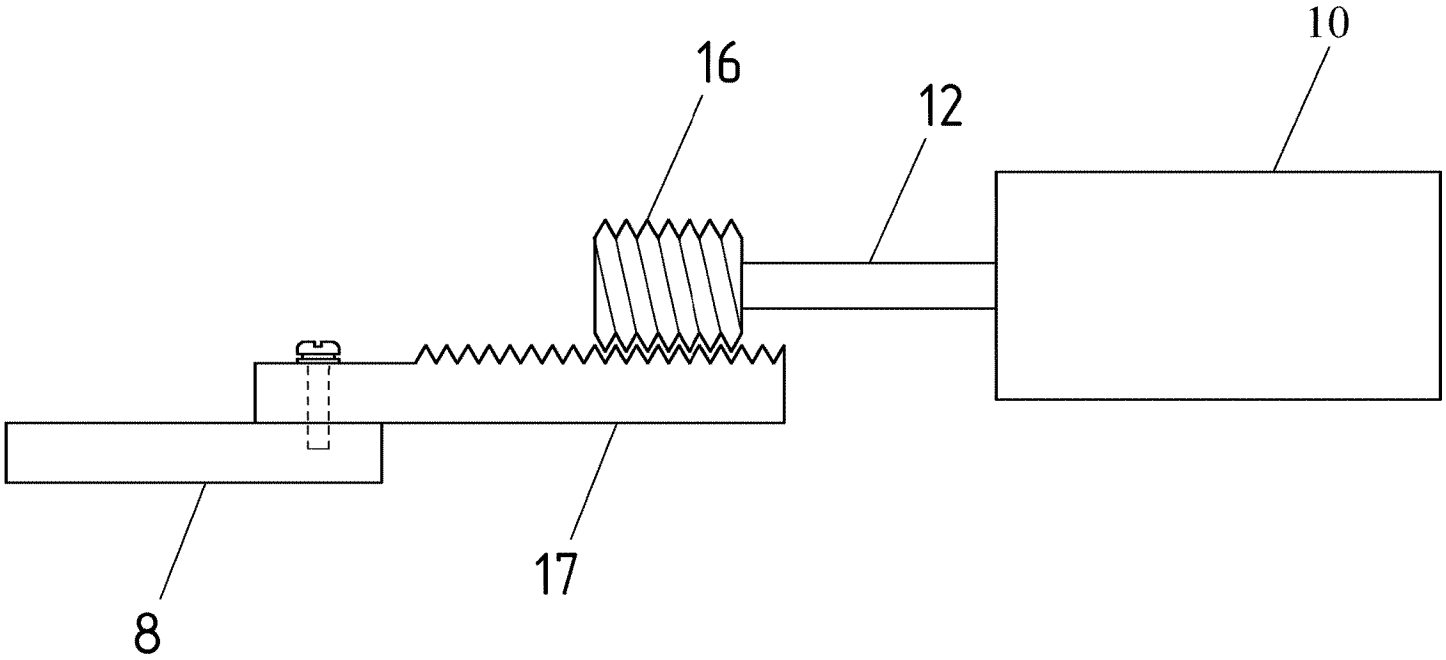
FIG. 2 shows one possible embodiment of the transmission mechanism in accordance with the present invention.

FIG. 2 shows one more possible variant of the transmission mechanism in the apparatus for sounding a string of stringed instrument in accordance with the present invention. The transmission mechanism of FIG. 2 comprises a worm gear wheel 16 secured to the output shaft 12 of second servo motor 10, and a mating gear rack 17 is made at the carriage 8 or the plate 7.

Figure 3:
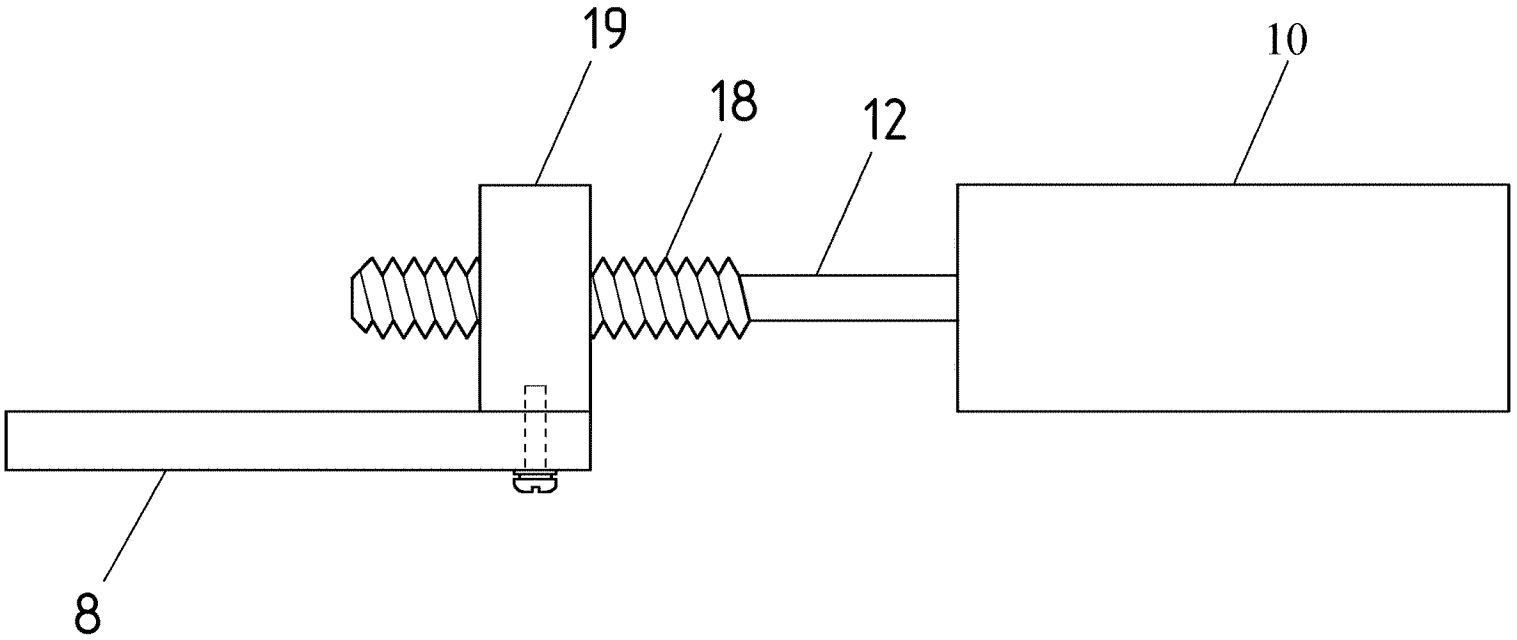
FIG. 3 shows another possible embodiment of the transmission mechanism in accordance with the present invention.

FIG. 3 shows one more possible variant of the transmission mechanism in the apparatus for sounding a string of stringed instrument in accordance with the present invention. The transmission mechanism of FIG. 3 comprises one element 18 of screw-gear secured to the output shaft 12 of second servo motor 10, and the second element 19 of the screw-gear is connected to the carriage 8 or the plate 7. In FIG. 3, the first element 18 of screw-gear is a threaded bar, and the second element 19 is a plate with a hole ("nut") having a mating thread therein. But an inverse relation is also possible, when the plate having a threaded hole is secured at the output shaft 12, and the threaded bar is secured at the carriage 8.

In principle, the transmission mechanism from the second servo motor 10 to the carriage 8 or plate 7 could have any other type known for the skilled person or being developed in the future.

The apparatus for sounding a string of stringed instrument in accordance with the present inventions operates as follows.

Initially, the plate 7 (the carriage 8) is shifted into the end position thereof in FIG. 1, the working end of the mediator 2 touches a string 1 extending a little under that string 1.

When the string 1 should be sounded, the first servo motor 4 is switched on, and the output shaft 3 thereof is rotated deflecting the mediator 2 at such an angle that corresponds (is proportional to) a loudness level accepted for a sound should be performed. A specific relationship between the rotational angle of the output shaft 3 (the deflection angle of the mediator 2) and the sound loudness level is determined in advance for each string 1 and stored in the memory of the control means (not shown) assigning the signals for controlling the apparatus for sounding a string of stringed instrument in accordance with the present invention.

Note that the sound pitch adjustment of the sounding string is not considered in this specification.

After performing the above operations, a rotation of the output shaft 12 of the second servo motor 10 takes place, which effects, via the respective transmission mechanism, a displacement of the plate 7 (carriage 8) in FIG. 1. If the transmission mechanism is configured in accordance with FIG. 1, then the rotation of the output shaft 12 causes a deflection of the drive arm 13 and a shift of pivot anchorage of the linkage 14, which movement causes a displacement of the plate 7 (carriage 8) that is connected pivotally with the linkage 14 at another end thereof with the post 15. In the case when the transmission mechanism is configured in accordance with FIG. 2, the rotation of the output shaft 12 causes a rotation of the worm gear wheel 16 secured thereon (clockwise in FIG. 2), and this action, in its turn, forces the gear rack 17 attached rigidly to the plate 7 (carriage 8) to move upward. In the case when the transmission mechanism is configured in accordance with FIG. 3, the rotation of the output shaft 12 causes a rotation of the screw-gear element 18 (the threaded bar in FIG. 3) secured thereon, by means of which another screw-gear element 19 ("nut") secured rigidly at the plate 7 (carriage 8) moves (upward in FIG. 3).

The displacement of the plate 7 (carriage 8) upward causes the mediator 2 to breakaway from the pre-stretched string 1 in accordance with the rotational angle of the output shaft 3 of the first servo motor 4. As a result, the breakaway of the mediator 2 from the stretched string 1 causes that string 1 to sound. Then, the second servo motor 10 rotates inversely, thus resetting the plate 7 (carriage 8) until the elastic loop 6 touches the sounding and damping the sounding string. If the loop 6 is passed under the string 1, the second servo motor 10 continue to rotate in the same direction until the loop 6 touches the sounding string 1, thus damping oscillations thereof. After that, the second servo motor 10 rotates inversely, thus resetting the plate 7 (carriage 8), which causes the mediator 2 to get down. Herewith, the mediator 2 being in the result on the other side of the string 1 will be rotated, at the next step, with the first servo motor 4 inversely at an angle required for a needed loudness of this string 1 sounding during execution of the next note. In principle, the output shaft 3 of the first servo motor 4 can rotate also to the initial state, thus bringing the mediator 2 to the previous (initial) state. Those skilled in the art understand that this resetting of the mediator 2 should take place while the first servo motor 4 not come down yet to the initial state thereof with the second servo motor 10.

Thus, the apparatus for sounding a string of stringed instrument in accordance with the present invention provides the string to be sounded in the same way as a musician does, and is simpler that the known analogs.

What is claimed is:

1. An apparatus for sounding a string of a stringed instrument comprising:

a first servo motor serving to secure a mediator to an output shaft of the first servo motor and to rotate the mediator in opposing directions for ensuring interaction of the mediator with the string;

a guide disposed substantially orthogonally to string plane of the stringed instrument and serving to move the first servo motor from or to the string along one side of the guide;

a second servo motor mounted at the reverse side of the guide; and a transmission mechanism comprising its first end being coupled with an output shaft of the second servo motor and its second end being connected to the first servo motor.

2. The apparatus of claim 1, further comprising an elastic loop being secured at the first servo motor, the elastic loop being passed under the string and serving to damp oscillations of the string during motion of the first servo motor upward the guide or the elastic loop being disposed above the string and serving to damp oscillations of the string during motion of the first servo motor downward the guide.

3. The apparatus of claim 1, wherein the first servo motor is secured on a plate, the plate having a reverse side with a carriage capable of moving along the guide, and wherein the second end of the transmission mechanism is connected to the first servo motor via the plate or the carriage.

4. The apparatus of claim 3, wherein the transmission mechanism comprises a drive arm secured to the output shaft of the second servo motor, an end of the drive arm being connected pivotally to the plate or the carriage.

5. The apparatus of claim 3, wherein the transmission mechanism comprises a worm gear wheel secured to the output shaft of the second servo motor, and wherein the plate or the carriage comprises a mating gear rack.

6. The apparatus of claim 3, wherein the transmission mechanism comprises a first element of a screw-gear secured to the output shaft of the second servo motor, and wherein a second element of the screw-gear is connected to the plate or the carriage.

* * * * *